US010502490B2

(12) United States Patent
Ishii et al.

(10) Patent No.: US 10,502,490 B2
(45) Date of Patent: Dec. 10, 2019

(54) MAINTENANCE MANAGEMENT DEVICE AND METHOD FOR HIGH-TEMPERATURE FURNACE EQUIPMENT

(71) Applicant: Azbil Corporation, Tokyo (JP)

(72) Inventors: Shigeki Ishii, Tokyo (JP); Yuichi Kumazawa, Tokyo (JP); Satoshi Kadoya, Tokyo (JP); Katsumi Morikawa, Tokyo (JP)

(73) Assignee: Azbil Corporation, Tokyo (JP)

( * ) Notice: Subject to any disclaimer, the term of this patent is extended or adjusted under 35 U.S.C. 154(b) by 309 days.

(21) Appl. No.: 15/474,124

(22) Filed: Mar. 30, 2017

(65) Prior Publication Data

US 2017/0284740 A1 Oct. 5, 2017

(30) Foreign Application Priority Data

Mar. 31, 2016 (JP) ..... 2016-070198

(51) Int. Cl.
*F27D 19/00* (2006.01)

(52) U.S. Cl.
CPC ..... *F27D 19/00* (2013.01); *F27D 2019/0003* (2013.01); *F27D 2019/0096* (2013.01)

(58) Field of Classification Search
CPC ..... F27D 21/0021; F27D 19/00
See application file for complete search history.

(56) References Cited

U.S. PATENT DOCUMENTS

2017/0131033 A1* 5/2017 Bayram ..... F27D 21/0021
2017/0284740 A1* 10/2017 Ishii ..... F27D 19/00

FOREIGN PATENT DOCUMENTS

JP H08221481 A 8/1996
JP 20035822 A 1/2003
JP 2007233758 A * 9/2007

* cited by examiner

*Primary Examiner* — Scott R Kastler
(74) *Attorney, Agent, or Firm* — Oblon, McClelland, Maier & Neustadt, L.L.P.

(57) ABSTRACT

A maintenance management device that integrates point values for each element that exerts thermal stress on a high-temperature furnace, with an operation time of the high-temperature furnace as an integration period, in which the point values are obtained by converting actual values of a thermal stress of each of elements into a reference thermal stress. A point value obtained by converting a limit value of the thermal stress with which the high-temperature furnace can normally operate into the reference thermal stress is set as a lifetime thermal stress, the point value integrated with the operation time of the high-temperature furnace as the integration period is set as an accumulated thermal stress, and a remaining lifetime of the high-temperature furnace equipment is predicted from the result of subtracting the accumulated thermal stress from the lifetime thermal stress.

8 Claims, 3 Drawing Sheets

MAINTENANCE MANAGEMENT DEVICE AND METHOD FOR HIGH-TEMPERATURE FURNACE EQUIPMENT

CROSS-REFERENCE TO RELATED APPLICATION

This application claims priority to Japanese Application No. 2016-070198, filed on Mar. 31, 2016. This application is incorporated herein in its entirety.

TECHNICAL FIELD

The present invention relates to a maintenance management device and method for a high-temperature furnace equipment that preserves and controls a high-temperature furnace equipment.

BACKGROUND

Up to now, a combustion furnace, an electric furnace, or the like is used as a high-temperature furnace equipment, and in the high-temperature furnace equipment, an inside of the combustion chamber is heated to a high temperature by a flame by a burner.

In the high-temperature furnace equipment, a metal body such as a burner housing has a high temperature at the time of combustion, a low temperature at the time of stoppage, and is constantly subjected to a thermal stress. For that reason, in the high-temperature furnace equipment, the burner housing and so on are exchanged at a replacement cycle of 5 years, 10 years, etc. based on actual results, experience, intuition, and so on of each equipment.

SUMMARY

However, in the conventional method, since the replacement cycle of the burner housing and the like is determined based on the actual results, experience, intuition, and so on of each equipment, there has been a possibility that a cost increase would occur due to an unnecessary exchange or an equipment failure or the like would occur because the burner housing and the like have not been replaced with fresh ones although their lifetimes have elapsed.

As a technology for predicting the remaining lifetime of the equipment to perform the maintenance management of the equipment, there are, for example, technologies disclosed in Japanese Unexamined Patent Application Publication No. H08-221481 and Japanese Unexamined Patent Application Publication No. 2003-5822.

In Japanese Unexamined Patent Application Publication No. H08-221481, in a plurality of elements which stress an equipment to be managed, actual data for each of elements in a unit time is multiplied by a weight corresponding to a magnitude of the stress given to the equipment by each of the elements. A total value obtained by multiplying the integrated value by an operation time of the equipment is used as an index value of a total stress that has been exerted on the equipment up to then. However, since the lifetime of the equipment to be compared with the index value of the total stress is not obtained, the remaining lifetime of the equipment is not obtained.

In Japanese Unexamined Patent Application Publication No. 2003-5822, a deterioration model for predicting the remaining lifetime is set for each portion (component) configuring the equipment to be managed, and when a stress applied to the equipment changes, the deterioration model is modified. However, it is very troublesome to create the appropriate deterioration model, and the deterioration model must be modified according to a change in stress.

The present invention has been made to solve the above problems, and it is an object of the present invention to provide a maintenance management device and method for a high-temperature furnace equipment which are capable of predicting the remaining lifetime of a high-temperature furnace equipment easily and accurately without the use of a deterioration model, and being useful for maintenance management of the high-temperature furnace equipment.

In order to achieve the above object, the present invention includes a point value integrating portion that integrates point values for each of elements that exert a thermal stress on a high-temperature furnace equipment with operation time of the high-temperature furnace equipment as an integration period, in which a reference value of the amount of thermal stress per unit time received by the high-temperature furnace equipment is set as a reference thermal stress amount, and the point values are obtained by converting actual values of the amount of thermal stress for each of the elements into the reference thermal stress amount; and a remaining lifetime predicting portion that predicts a remaining lifetime of the high-temperature furnace equipment based on a result of subtracting an accumulated thermal stress amount from a lifetime thermal stress amount in which a point value obtained by converting a limit value of the thermal stress amount with which the high-temperature furnace equipment can normally operate into the reference thermal stress amount is set as the lifetime thermal stress amount, and point values integrated with the operation time of the high-temperature furnace equipment as an integration period is set as the accumulated thermal stress amount.

In the present invention, the point value integrating portion (104, 205) integrates the point values for each of the elements that exert the thermal stress on the high-temperature furnace equipment with the operation time of the high-temperature furnace equipment as the integration period, in which the point values obtained by converting the actual values of the thermal stress amount into the reference thermal stress amount (the reference value of the thermal stress amount per the unit time which is received by the high-temperature furnace equipment) for each of the elements. For example, the reference thermal stress amount is set to one point, the actual values of the thermal stress amount are converted into points for each of the elements that exert the thermal stress on the high temperature furnace equipment, and the pointed numerical values for each of the elements are integrated with the operation time of the high-temperature furnace equipment as the integration period.

In the present invention, the remaining lifetime predicting portion sets a point value obtained by converting a limit value of the thermal stress amount with which the high-temperature furnace equipment can normally operate into the reference thermal stress amount as the lifetime thermal stress amount, sets the point value integrated with the operation time of the high-temperature furnace equipment as the integration period as the accumulated thermal stress amount, and predicts the remaining lifetime of the high-temperature furnace equipment from the result of subtracting the accumulated thermal stress amount from the lifetime thermal stress amount. For example, the remaining lifetime predicting portion sets a value obtained by converting an average value of the thermal stress amount received by the high-temperature furnace equipment per unit time into the point value as an average value of the thermal stress amount per the unit time, and sets a result of dividing a result obtained by subtracting the accumulated thermal stress amount from the lifetime thermal stress amount by the average value of the thermal stress amount per the unit time as a predicted value of the remaining lifetime of the high-temperature furnace equipment.

In the above description, the components in the drawings corresponding to components of the invention are indicated by reference numerals enclosed in parentheses.

According to the present invention, the point value for each of the elements that exert the thermal stress on the high-temperature furnace equipment is integrated with operation time of the high-temperature furnace equipment as the integration period, in which the reference value of the amount of thermal stress per unit time received by the high-temperature furnace equipment is set as the reference thermal stress amount, and the point values are obtained by converting the actual values of the amount of thermal stress for each of the elements into the reference thermal stress amount, and the remaining lifetime of the high-temperature furnace equipment is predicted based on the result of subtracting the accumulated thermal stress amount from the lifetime thermal stress amount in which the point value obtained by converting the limit value of the thermal stress amount with which the high-temperature furnace equipment can normally operate into the reference thermal stress amount as the lifetime thermal stress amount, and the point values integrated with the operation time of the high-temperature furnace equipment as the integration period as the accumulated thermal stress amount. As a result, the remaining lifetime of a high-temperature furnace equipment can be predicted easily and accurately without the use of a deterioration model, and be useful for maintenance management of the high-temperature furnace equipment.

DETAILED DESCRIPTION

An example of the present invention will be described in detail below with reference to the drawings.

EXAMPLE

Figure 1:
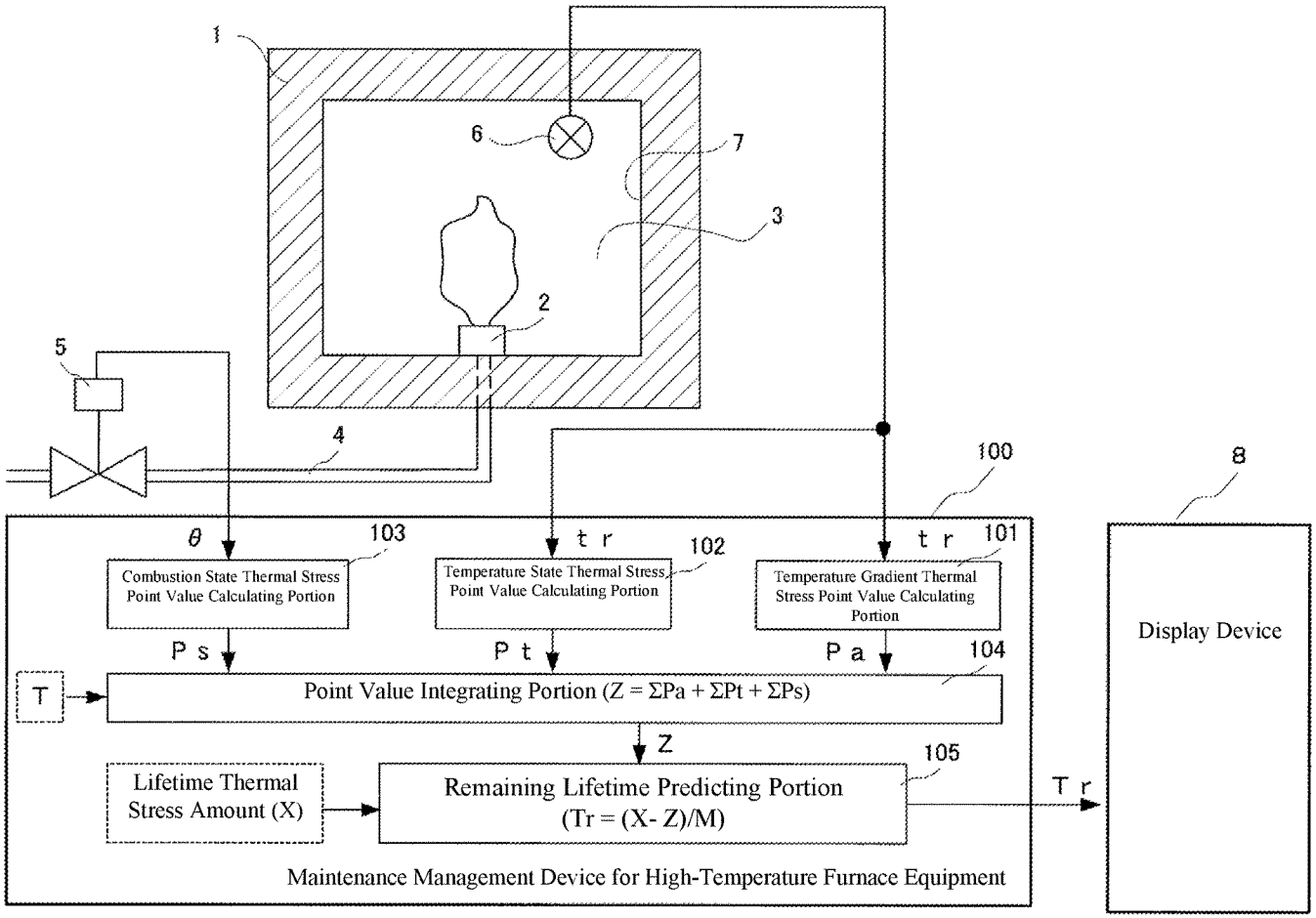
FIG. 1 is a configuration diagram of a system using a maintenance management device of a high-temperature furnace equipment according to an example of the present invention.

FIG. 1 is a configuration diagram of a system using a maintenance management device of a high-temperature furnace equipment according to an example of the present invention.

In FIG. 1, reference numeral 1 denotes a high-temperature furnace equipment to be controlled, which heats an interior of a combustion chamber 3 to a high temperature by a flame from a burner 2. For example, the high-temperature furnace equipment 1 sets the interior of the combustion chamber 3 to 500° C. or higher. A valve 5 is provided in a fuel supply passage 4 to the burner 2, and an intensity of the flame from the burner 2 is changed by adjusting an opening degree θ of the valve 5. The high-temperature furnace equipment 1 is provided with a temperature sensor 6 that detects a temperature inside the combustion chamber 3 as tr. Reference numeral 7 denotes a burner housing (metal body).

The system is equipped with a maintenance management device (hereinafter simply referred to as "maintenance management device") 100 for a high-temperature furnace equipment according to the first example of the present invention. A display device 8 is provided as a device for displaying a processing result in the maintenance management device 100 on a screen.

The maintenance management device 100 is realized by hardware including a processor and a memory device and a program realizing various functions in cooperation with those hardware, and includes a temperature gradient thermal stress point value calculating portion 101, a temperature state thermal stress point value calculating portion 102, a combustion state thermal stress point value calculating portion 103, a point value integrating portion 104, and a remaining lifetime predicting portion 105.

Hereinafter, the function of each portion in the maintenance management device 100 will be described with the operation of each relevant portion. In the example, the elements that exert a thermal stress on the high-temperature furnace equipment 1 include three elements of a temperature gradient, a temperature state, and a combustion state. Further, a reference value of the thermal stress amount per unit time which is received by the high-temperature furnace equipment 1 is defined as a reference thermal stress amount, and the reference thermal stress amount is set to one point. In this example, the thermal stress amount at 500° C. for one minute (unit time) is set to one point (reference thermal stress amount).

The temperature gradient thermal stress point value calculating portion 101 receives a temperature tr in the combustion chamber 3 which is detected by the temperature sensor 6 and calculates a point value Pa obtained by converting an actual value of the thermal stress amount of a temperature gradient received by the high-temperature furnace equipment 1 into the reference thermal stress amount per unit time according to the following equation (1).

$$Pa=f(|T(t0)-T(t1)|) \quad (1)$$

In the equation (1), T(t0) represents an actual value of the thermal stress amount in a previous temperature state, and T(t1) represents the actual value of the thermal stress amount in the present temperature state. The point value Pa is a point value of the actual value of the thermal stress amount of the temperature gradient received by the high-temperature furnace equipment 1, and when the temperature gradient becomes steep, the point value Pa increases (a steeper gradient leads to a larger numerical value).

The temperature state thermal stress point value calculating portion 102 receives a temperature tr in the combustion chamber 3 which is detected by the temperature sensor 6 and calculates a point value Pt obtained by converting an actual value of the thermal stress amount of a temperature state received by the high-temperature furnace equipment 1 into the reference thermal stress amount per unit time according to the following equation (2).

$$Pt=f(T(t1)) \quad (2)$$

In the equation (2), T(t1) represents an actual value of the thermal stress amount in the present temperature state. The point value Pt is a point value of the actual value of the thermal stress amount of the temperature state received by the high-temperature furnace equipment 1, and as the temperature gradient becomes steeper, the point value Pa increases more (the higher temperature leads to the larger numerical value).

The combustion state thermal stress point value calculating portion 103 receives an opening degree θ of the valve 5 and calculates a point value Ps obtained by converting an actual value of the thermal stress amount of a combustion state received by the high-temperature furnace equipment 1 into the reference thermal stress amount per unit time according to the following equation (3).

$$Ps=f(S(t1)) \quad (3)$$

In the equation (3), S(t1) represents an actual value of the thermal stress amount in the present combustion state. The point value Ps is a point value of the actual value of the thermal stress amount of the combustion state received by the high-temperature furnace equipment 1, and as the combustion becomes higher, the point value Ps increases more (the higher combustion leads to the larger numerical value, the lower combustion leads to the intermediate numerical value, and the stoppage leads to the smaller numerical value).

The point value integrating portion 104 receives the point value Pa from the temperature gradient thermal stress point value calculating portion 101, the point value Pt from the temperature state thermal stress point value calculating portion 102, and the point value Ps from the combustion state thermal stress point value calculating portion 103 Ps as point values for each of the elements, and integrates the point value for each of the elements with the operation time T of the high-temperature furnace equipment 1 as the integration period.

In other words, the point value integrating portion 104 sets the past operation time T of the high-temperature furnace equipment 1 as the integration period, obtains a total value ΣPa of the point values Pa during the integration period, a total value ΣPt of the point values Pt, and a total value ΣPs of the point values Pt, and sets a sum of those total values ΣPa, ΣPt and ΣPs as an integrated value Z (Z=ΣPa+ΣPt+ΣPs) of the point values.

Figure 2:
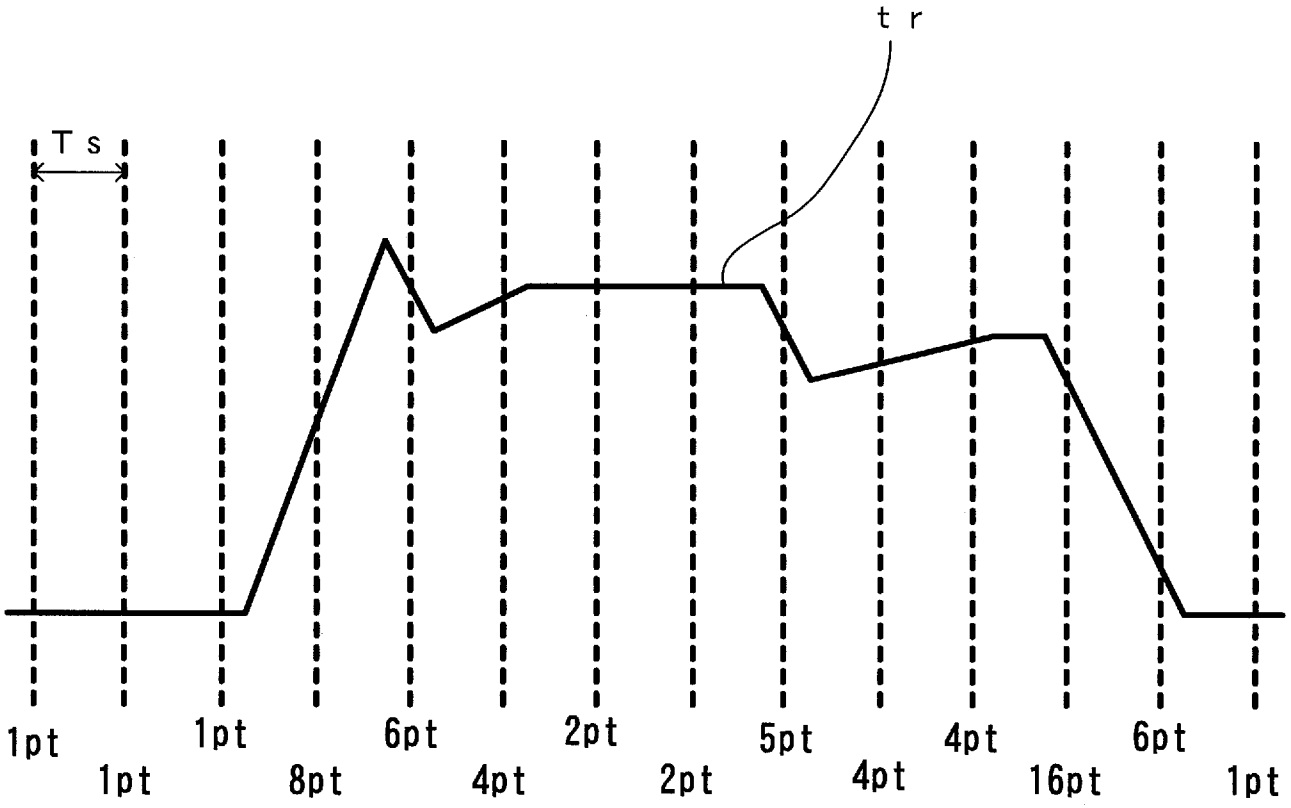
FIG. 2 is a diagram illustrating an example of a change in a total value of point values for each of elements per unit time in combination with a change in temperature in a combustion chamber.

FIG. 2 illustrates an example of a change in a total value (Pa+Pt+Ps) of the point values for each of the elements per unit time in combination with a change in the temperature tr in the combustion chamber 3. In FIG. 2, Ts is a unit time, and a total value of the point values Pa, Pt, and Ps changes for each unit time Ts. The integrated value Z calculated by the point value integrating portion 104 is obtained by integrating the total value of the point values Pa, Pt, and Ps for each unit time Ts with the operation time T of the high-temperature furnace equipment 1 as an integration period.

The remaining lifetime predicting portion 105 sets the point value obtained by converting the limit value of the thermal stress amount with which the high-temperature furnace equipment 1 can normally operate into the reference thermal stress amount as a lifetime thermal stress amount X, sets the integrated value Z (the point value integrated with the operation time T of the high-temperature furnace equipment 1 as the integration period) of the point value calculated by the point value integrating portion 104 as the accumulated thermal stress amount, and predicts the remaining lifetime of the high-temperature furnace equipment 1 from the result of subtracting the accumulated thermal stress amount Z from the lifetime thermal stress amount X.

In more detail, the remaining lifetime predicting portion 105 sets a value obtained by converting an average value of the thermal stress amount received by the high-temperature furnace equipment 1 per unit time into the point value as an average value M of the thermal stress amount per the unit time, and sets a result of dividing a result obtained by subtracting the accumulated thermal stress amount Z from the lifetime thermal stress amount X by the average value M of the thermal stress amount per the unit time as a predicted value Tr (Tr=(X−Z)/M) of the remaining lifetime of the high-temperature furnace equipment 1.

The lifetime thermal stress amount X used in the remaining lifetime predicting portion 105 is predetermined as a point value converted into the reference thermal stress amount based on the operation record of the high-temperature furnace equipment 1 and the test data. The lifetime thermal stress amount X is set in the maintenance management device 100, and the set lifetime thermal stress amount X is read out and used by the remaining lifetime predicting portion 105. The operation time T of the high-temperature furnace equipment 1, which is set as the integration period, is a time counted as the past operation time of the high-temperature furnace equipment 1, and the counted operation time T is given to the point value integrating portion 104. Further, the predicted value Tr of the remaining lifetime of the high-temperature furnace equipment 1 obtained by the remaining lifetime predicting portion 105 is output to the display device 8 and displayed on a screen of the display device 8.

In this manner, in the example, in the maintenance management device 100, the predicted value Tr of the remaining lifetime of the high-temperature furnace equipment 1 is easily and accurately obtained without the use of the deterioration model. Further, the predicted value Tr of the remaining lifetime of the high-temperature furnace equipment 1, which is obtained by the maintenance management device 100 is displayed on the screen of the display device 8 so as to be useful for the maintenance management of the high-temperature furnace equipment 1. In other words, since the remaining lifetime of the high-temperature furnace equipment 1 is numerically visualized, the maintenance prediction is performed and can be used for safe operation of the equipment, securing of budget, and the like. In addition, there is no risk that a cost increase would occur due to an unnecessary exchange or an equipment failure or the like would occur because the components have not been replaced with fresh ones although their lifetimes have elapsed. The cost reduction is realized, and the safe operation of the equipment is obtained.

In the example, the elements that exert the thermal stress on the high-temperature furnace equipment 1 include three elements of the temperature gradient, the temperature state, and the combustion state. However, the element may be only the temperature gradient, for example. Further, the number of times of starting and stopping the burner, an activating time, the operation time, and the like may be taken into consideration as the elements affecting the thermal stress amount of the high-temperature furnace equipment 1. For example, a method is conceivable in which an acceleration coefficient caused by the equipment activating time is determined and a furnace whose activating time is long increases the thermal stress amount.

ANOTHER EXAMPLE

Figure 3:
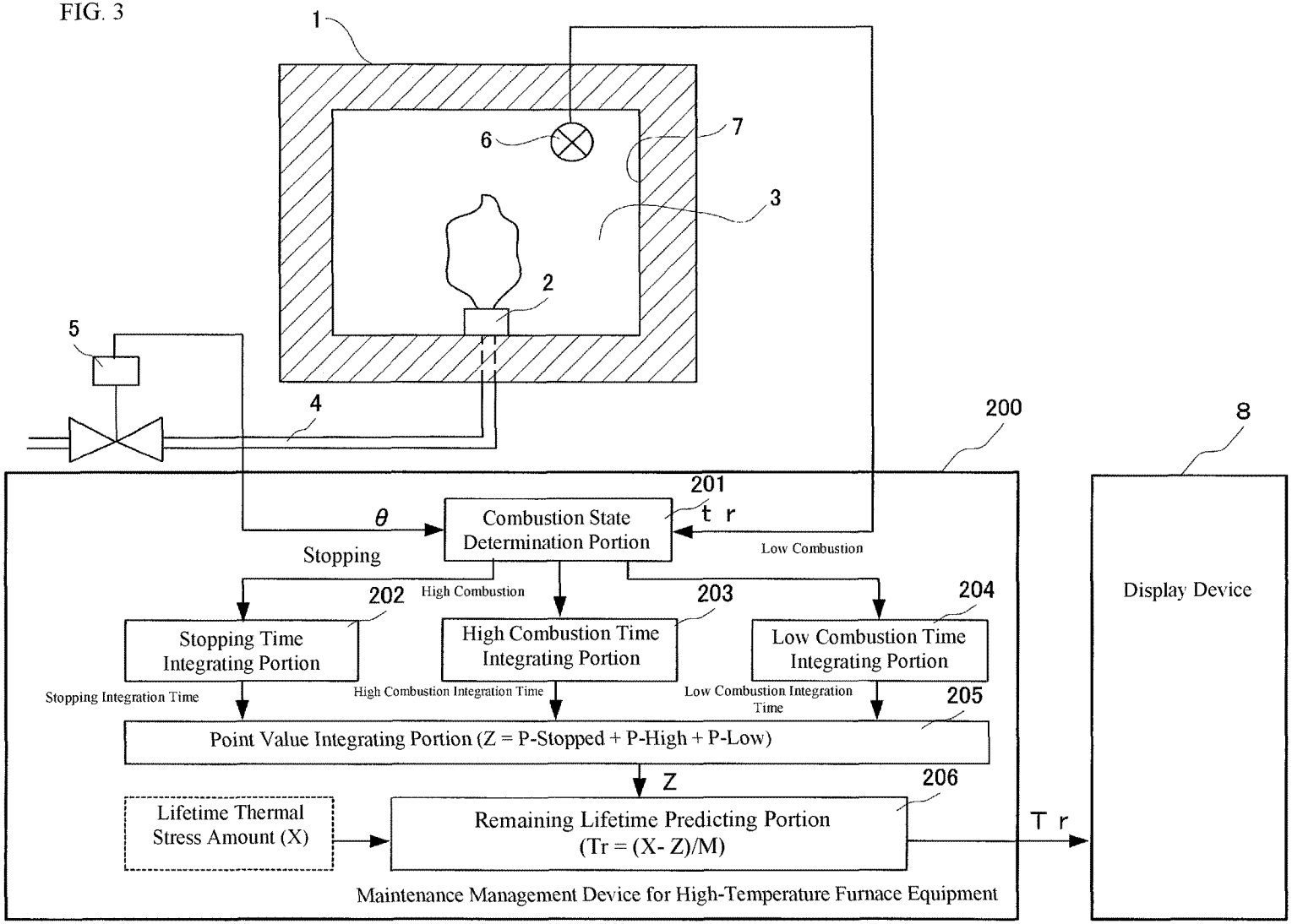
FIG. 3 is a configuration diagram of a system using a maintenance management device for a high-temperature furnace equipment according to another example of the present invention.

FIG. 3 is a configuration diagram of a system using a maintenance management device of a high-temperature furnace equipment according to another example of the present invention. In this drawing, the same reference numerals as in FIG. 1 indicate the same or similar components described with reference to FIG. 1 and their descriptions will be omitted.

The system is equipped with a maintenance management device (hereinafter simply referred to as "maintenance management device") 200 for a high-temperature furnace equipment according to this example of the present invention. The maintenance management device 200 according to this example is used for the high-temperature furnace equipment 1 that can simplify a model such as a constant furnace temperature.

The maintenance management device 200 is realized by hardware including a processor and a memory device and a program realizing various functions in cooperation with those hardware and includes a combustion state determination portion 201, a stop time integrating portion 202, a high combustion time integrating portion 203, a low combustion time integrating portion 204, a point value integrating portion 205, and a remaining lifetime predicting portion 206.

Hereinafter, the function of each portion in the maintenance management device 200 will be described with the operation of each relevant portion. In this example, the elements that exert the thermal stress on the high-temperature furnace equipment 1 include three elements of a stopping state, a high combustion state, and a low combustion state. Further, a reference value of the thermal stress amount per unit time which is received by the high-temperature furnace equipment 1 is defined as a reference thermal stress amount, and the reference thermal stress amount is set to one point. This feature is identical with that in the previous example.

The combustion state determination portion 201 receives the temperature tr in the combustion chamber 3 detected by the temperature sensor 6 and the opening degree θ of the valve 5 and determines the combustion state of the high-temperature furnace equipment 1. For example, the combustion state determination portion 201 classifies the combustion state into three states of "a stopping state", "a high combustion state", and "a low combustion state" for each unit time, and determines the combustion state of the high-temperature furnace equipment 1.

The determination result of the combustion state determination portion 201 is that "the stopping state" is sent to the stopping time integrating portion 202, "the high combustion state" is sent to the high combustion time integrating portion 203, and "the low combustion state" is sent to the low combustion time integrating portion 204.

Every time the determination result of "the stopping state" is input from the combustion state determination portion 201, the stopping time integrating portion 202 integrates one input of the determination result of "the stopping state" as one unit time, and outputs the integrated value (the integrated value of the unit time) as the stopping integration time.

Every time the determination result of "the high combustion state" is input from the combustion state determination portion 201, the high combustion time integrating portion 203 integrates one input of the determination result of "the high combustion state" as one unit time, and outputs the integrated value (the integrated value of the unit time) as the high combustion integration time.

Every time the determination result of "the low combustion state" is input from the combustion state determination portion 201, the low combustion time integrating portion 204 integrates one input of the determination result of "the low combustion state" as one unit time, and outputs the integrated value (the integrated value of the unit time) as the low combustion integration time.

The point value integrating portion 205 receives the stopping integration time from the stopping time integrating portion 202, the high combustion integration time from the high combustion time integrating portion 203, and the low-combustion integration time from the low combustion time integrating portion 204. The point value integrating portion 205 obtains a P stop (P stop=α×[stopping integration time]) as the point value obtained by converting the actual value of the stopping thermal stress amount into the reference thermal stress amount by multiplying the stopping integration time by a predetermined coefficient α, a P high (P high=β×[high combustion integration time]) as the point value obtained by converting the actual value of the high combustion thermal stress amount into the reference thermal stress amount by multiplying the high combustion integration time by a predetermined coefficient β(β>α), and a P low (P low=γ×[low combustion integration time]) as the point value obtained by converting the actual value of the low combustion thermal stress amount into the reference thermal stress amount by multiplying the low combustion integration time by a predetermined coefficient γ(β>γ>α). The point value integrating portion 205 sets a sum of the P stop, the P high, and the P low thus obtained as the integrated value Z (Z=P stop+P high+P low) of the point values.

The integrated value Z of the point values obtained by the point value integrating portion 205 is a value obtained by integrating the point value for each of the elements with the operation time T (T=stopping integration time+high combustion integration time+low combustion integration time) of the high-temperature furnace equipment 1 as the integration period, with the reference value of the thermal stress amount per unit time received by the high temperature furnace equipment 1 as the reference thermal stress amount, the actual value of the thermal stress amount as the point value converted into the reference thermal stress amount for each of the elements which exert the thermal stress on the high temperature furnace equipment 1 (the stopping state, the high combustion state, the low combustion state).

The remaining lifetime predicting portion 206 sets the point value obtained by converting the limit value of the thermal stress amount with which the high-temperature furnace equipment 1 can normally operate into the reference thermal stress amount as the lifetime thermal stress amount X, sets the integrated value Z (the point value integrated with the operation time T of the high-temperature furnace equipment 1 as the integration period) of the point values calculated by the point value integrating portion 205 as the accumulated thermal stress amount, and predicts the remaining lifetime of the high-temperature furnace equipment 1 from the result of subtracting the accumulated thermal stress amount Z from the lifetime thermal stress amount X.

In more detail, the remaining lifetime predicting portion 206 sets a value obtained by converting an average value of the thermal stress amount received by the high-temperature furnace equipment 1 per unit time into the point value as an average value M of the thermal stress amount per the unit time, and sets a result of dividing a result obtained by subtracting the accumulated thermal stress amount Z from the lifetime thermal stress amount X by the average value M of the thermal stress amount per the unit time as a predicted value Tr (Tr=(X−Z)/M) of the remaining lifetime of the high-temperature furnace equipment 1. Further, the predicted value Tr of the remaining lifetime of the high-temperature furnace equipment 1 obtained by the remaining lifetime predicting portion 206 is output to the display device 8 and displayed on a screen of the display device 8.

In this manner, similarly, in this example, in the maintenance management device 200, the predicted value Tr of the remaining lifetime of the high-temperature furnace equipment 1 is easily and accurately obtained without the use of the deterioration model. Further, the predicted value Tr of the remaining lifetime of the high-temperature furnace equipment 1, which is obtained by the maintenance management device 200 is displayed on the screen of the display device 8 so as to be useful for the maintenance management of the high-temperature furnace equipment 1.

Expansion of Example

Although the invention has been described with reference to the examples above, the invention is not limited to the above examples. Various changes understandable to those skilled in the art can be made to the structure and details of the invention within the technical spirit of the invention. In addition, examples can be practiced in any combination without occurrence of a contradiction.

What is claimed is:

1. A maintenance management device for a high-temperature furnace equipment, the maintenance management device comprising:

processing circuitry configured to numerically integrate point values for each of a plurality of thermal factors that each exert a thermal stress on a high-temperature furnace equipment, using an operation time of the high-temperature furnace equipment as an integration period, the point values being obtained from information received from sensors/actuators of the high-temperature furnace equipment, wherein the processing circuitry is configured to set a reference value of an amount of thermal stress per unit time received by the high-temperature furnace equipment as a reference thermal stress amount, and obtain the point values by converting actual values of the amount of thermal stress for each of the thermal factors into units of the reference thermal stress amount; and predict a remaining lifetime of the high-temperature furnace equipment based on a result of subtracting an accumulated thermal stress amount from a lifetime thermal stress amount, wherein the processing circuitry is configured to set the lifetime thermal stress amount as a point value obtained by converting a limit value of the thermal stress amount with which the high-temperature furnace equipment can normally operate into units of the reference thermal stress amount, and set point values integrated using the operation time of the high-temperature furnace equipment as an integration period as the accumulated thermal stress amount.

2. The maintenance management device for a high-temperature furnace equipment according to claim 1, wherein the processing circuitry is further configured to integrate the point values for the thermal factors that exert the thermal stress on the high-temperature furnace equipment, which include a temperature gradient, a temperature state, and a combustion state.

3. The maintenance management device for a high-temperature furnace equipment according to claim 1, wherein the processing circuitry is further configured to integrate the point values for the thermal factors that exert the thermal stress on the high temperature furnace equipment, which include a stopping state, a high combustion state, and a low combustion state.

4. The maintenance management device for a high-temperature furnace equipment according to claim 1, wherein the processing circuitry is further configured to set a value obtained by converting an average value of the thermal stress amount received by the high-temperature furnace equipment per unit time into a point value, as an average value of the thermal stress amount per the unit time, and set a result of dividing a result obtained by subtracting the accumulated thermal stress amount from the lifetime thermal stress amount by the average value of the thermal stress amount per the unit time, as a predicted value of the remaining lifetime of the high-temperature furnace equipment.

5. A maintenance management method for a high-temperature furnace equipment, comprising:

numerically integrating, by processing circuitry, point values for each of a plurality of thermal factors that each exert a thermal stress on a high-temperature furnace equipment, using an operation time of the high-temperature furnace equipment as an integration period, the point values being obtained from information received from sensors/actuators of the high-temperature furnace equipment, wherein a reference value of the amount of thermal stress per unit time received by the high-temperature furnace equipment is set as a reference thermal stress amount, and the point values are obtained by converting actual values of the amount of thermal stress for each of the thermal factors into units of the reference thermal stress amount; and predicting, by the processing circuitry, a remaining lifetime of the high-temperature furnace equipment based on a result of subtracting an accumulated thermal stress amount from a lifetime thermal stress amount, wherein a point value obtained by converting a limit value of the thermal stress amount with which the high-temperature furnace equipment can normally operate into the reference thermal stress amount is set as the lifetime thermal stress amount, and point values integrated using the operation time of the high-temperature furnace equipment as an integration period is set as the accumulated thermal stress amount.

6. The maintenance management method of claim 5, wherein the integrating step comprises numerically integrating the point values for the thermal factors that exert the thermal stress on the high-temperature furnace equipment, which include a temperature gradient, a temperature state, and a combustion state.

7. The maintenance management method of claim 5, wherein the integrating step comprises numerically integrating the point values for the thermal factors that exert the thermal stress on the high temperature furnace equipment, which include a stopping state, a high combustion state, and a low combustion state.

8. The maintenance management method of claim 5, wherein the predicting step comprises setting a value obtained by converting an average value of the thermal stress amount received by the high-temperature furnace equipment per unit time into a point value, as an average value of the thermal stress amount per the unit time, and setting a result of dividing a result obtained by subtracting the accumulated thermal stress amount from the lifetime thermal stress amount by the average value of the thermal stress amount per the unit time, as a predicted value of the remaining lifetime of the high-temperature furnace equipment.

* * * * *